United States Patent [19]

Winship

[11] Patent Number: 4,655,148

[45] Date of Patent: Apr. 7, 1987

[54] METHOD OF INTRODUCING DRY SULFUR OXIDE ABSORBENT MATERIAL INTO A FURNACE

[75] Inventor: Ralph D. Winship, Ottawa, Canada

[73] Assignee: Combustion Engineering, Inc., Windsor, Conn.

[21] Appl. No.: 792,392

[22] Filed: Oct. 29, 1985

[51] Int. Cl.[4] ..... F23D 1/00

[52] U.S. Cl. ..... 110/347; 110/345; 110/264; 110/265

[58] Field of Search ..... 110/347, 345, 261, 263–265

[56] References Cited

U.S. PATENT DOCUMENTS

| | | | |
|---|---|---|---|
| 3,851,042 | 11/1974 | Minnick | 423/244 |
| 4,150,631 | 4/1979 | Frey et al. | 110/265 |
| 4,294,178 | 10/1981 | Borio et al. | 110/265 |
| 4,411,204 | 10/1983 | Hamilton | 110/347 |
| 4,426,939 | 1/1984 | Winship | 110/347 |
| 4,434,726 | 3/1984 | Jones | 110/347 |
| 4,442,783 | 4/1984 | Pajonas et al. | 110/347 |
| 4,475,472 | 10/1984 | Adrian et al. | 110/347 |
| 4,501,204 | 2/1985 | McCantney et al. | 110/264 |
| 4,509,436 | 4/1985 | Schrofelbauer et al. | 110/345 |
| 4,519,995 | 5/1985 | Schrofelbauer et al. | 110/345 |
| 4,547,351 | 10/1985 | Im et al. | 110/345 |
| 4,555,996 | 12/1985 | Torbov et al. | 110/345 |
| 4,570,551 | 2/1986 | Derbidge et al. | 110/347 |

*Primary Examiner*—Henry C. Yuen

*Attorney, Agent, or Firm*—William W. Hablet

[57] ABSTRACT

Emissions of sulfur oxides produced during combustion of a sulfur-bearing fossil fuel in a furnace chamber 10 are reduced by injecting a sulfur oxide absorbing particulate into the product gases in an upper region 60 of the furnace chamber. The sulfur oxide absorbing material is dispersed into a quantity of air which is introduced in the furnace chamber through a plurality of nozzles 80, 82 and 84 disposed at different elevations. The air streams with entrained absorbent are introduced at each elevation tangent to an imaginary circle, with the radii of the circles of the elevations being different, thereby distributing the sulfur oxide absorbent over a wide volume of the furnace chamber.

5 Claims, 2 Drawing Figures

METHOD OF INTRODUCING DRY SULFUR OXIDE ABSORBENT MATERIAL INTO A FURNACE

BACKGROUND OF THE INVENTION

The present invention relates generally to the operation of fossil fuel-fired steam generator furnaces, and more particularly, to an improved method of introducing a dry sulfur oxide absorbent material, typically an alkali material such as limestone or lime powder, into a steam generator furnace firing a sulfur-bearing fossil fuel so as to optimize the efficiency of sulfur-oxide absorption over a wide range of furnace operating conditions.

Fossil fuels, such as oil, coal, peat, and lignite, are commonly used in steam generating furnaces to produce hot combustion products which in turn are used to generate steam to power electric producing turbine generators. However, due to the presence of nitrogen and sulfur compounds in such fossil fuels, the combustion of these fuels in steam generating furnaces creates obnoxious gases such as nitrogen oxides and sulfur oxides which must be removed from the flue gas generated in the furnace prior to venting the flue gas to the atmosphere. The formation of nitrogen oxides in fossil fuel fired furnaces is typically controlled by properly distributing the admission of combustion air to the furnace so as to provide a zone of initial combustion at substoichiometric levels and a subsequent secondary zone above the primary combustion zone to provide for complete combustion within the furnace. The removal of sulfur oxides from the flue gas on the other hand has typically been accomplished by scrubbing the product flue gas at a point downstream of the furnace after the gases have been cooled. Unfortunately, the equipment necessary to remove sulfur oxides from flue gases by scrubbing requires a large capital outlay and continued maintenance expenses to provide reliable operation.

Accordingly, effort has been made to remove the sulfur oxides from the flue gas within the furnace chamber itself by injecting a dry sulfur absorbing particulate material into the furnace. As the sulfur oxides are formed during combustion within the furnace, the sulfur oxides will, to varying extent, be absorbed by the particulate sulfur absorbing material within the furnace and carried from the furnace chamber entrained in the product flue gas. The sulfated absorbent particles will be removed in a downstream particulate collecter, such as an electrostatic precipitator, which is typically supplied with the steam generator to remove fly ash and other particulates from the flue gas prior to venting to the atmosphere.

Typically, the sulfur absorbing particulate material is added directly into the combustion zone of the furnace to be in intimate contact with the fuel during the combustion process. For example, U.S. Pat. No. 4,426,939 discloses injecting the sulfur oxide absorbing material into the stream of powdered fuel being passed from the pulverizer to the burners of the furnace. U.S. Pat. No. 4,262,610 discloses mixing the sulfur oxide absorbent material with the coal to be burned in the furnace upstream of the pulverizer so that the coal and the sulfur oxide absorbent are pulverized together. U.S. Pat. No. 3,746,498 discloses injecting the sulfur oxide absorbing material directly into the furnace combustion zone into a region of fuel-rich combustion. U.S. Pat. No. 3,520,649 discloses injecting a sulfur absorbent particulate material entrained in air directly into the high temperature burning zone. In each of these methods wherein the sulfur oxide absorbent material is actually present in the high temperature combustion zone of the furnace, the sulfur oxide absorbent material is subjected to extremely high temperatures and therefore may be deadburned thereby resulting in the material becoming ineffective as the sulfur oxide absorbent.

One method of avoiding deadburning is to inject the sulfur oxide absorbent into the furnace at a location downstream from the combustion zone wherein the gases have cooled to a temperature wherein deadburning does not occur. One such method is disclosed in U.S. Pat. No. 3,851,042 wherein fully hydrated lime particles are injected into the upper region of a furnace chamber in a stream of pressurized steam at a location wherein the gas temperature is in the range of about 650 C. to about 1300 C. As disclosed therein, the fully hydrated lime entrained in the pressurized steam is injected through an opening in the sidewall of the furnace across the path of the flue gases leaving the furnace chamber. One problem associated with this method of injection of the sulfur oxide absorbent particulate material downstream of the high temperature combustion zone is the difficulty of providing intimate mixing of the sulfur oxide absorbent with the flue gases so as to facilitate sulfur oxide absorption. In systems wherein the sulfur oxide absorbent is directly injected into the high temperature combustion zone, the sulfur oxide absorbent particulate material is present in the immediate vicinity of the combusting fuel particles. However, when injected into the product flue gas downstream of the combustion zone, the sulfur oxide absorbent material is not in intimate contact with the combusting fuel particles and therefore is not in the immediate vicinty of the sulfur oxide molecule as it is formed.

Accordingly, it is an object of the present invention to provide a method of injecting a sulfur oxide absorbent particulate material into a furnace to absorb sulfur oxide formed therein in such a manner as to ensure rapid and thorough mixing of the injected sulfur oxide absorbent with the product flue gases.

SUMMARY OF THE INVENTION

The present invention provides a method of introducing dry sulfur oxide absorbing particulate material into a fossil fuel fired steam generator. A sulfur oxide bearing fuel is combusted in a first quantity of air in a first zone in a lower region of a vertically elongated furnace remote from the gas outlet of the furnace to generate hot product gases. A sulfur oxide absorbing particulate material is dispersed in a second quantity of air and injected into the product gas in a second zone in an upper region of the furnace between the first zone and the gas outlet of the furnace. The gas temperature is preferably in the range of from about 800 C. up to about 2250 C. to 2600 C., depending upon the absorbent being used, at the location within the second zone wherein the sulfur oxide absorbent is introduced into the product gas.

In accordance with the present invention, the sulfur oxide absorbing material dispersed in the second quantity of air is injected into the product gas at at least a first and a second elevation within the second zone through a plurality of air streams introduced into the furnace of each elevation. The air streams introduced at the first elevation are directed tangentially to a first imaginary circle within the second zone, while the air streams introduced at the second elevation are directed tangentially to a second imaginary circle within the second zone. The first and second imaginary circles are at different elevations within the second zone and have differing radii. In this manner, the sulfur oxide absorbent is dispersed over a wide volume of the furnace enclosure thereby ensuring more rapid and more wide spread distribution of the sulfur oxide absorbent throughout the product gases leaving the furnace chamber.

The quantity of air in the air streams into which the sulfur oxide absorbing material is dispersed for introduction at the first and second elevations is independently controlled so that the velocity of the streams of air into which the sulfur oxide absorbent is dispersed may be independently controlled between the first and second elevations. The air may also be unequally distributed between the first and second elevations when preferred to effect desired changes in the temperature profile of the product gases leaving the furnace chamber. Preferably, the plurality of air streams with sulfur oxide absorbing particulate material dispersed therein may be selectively directed into the furnace either upwardly toward the gas outlet of the furnace, horizontally across the furnace chamber, or downwardly away from the gas outlet of the furnace so that the sulfur oxide absorbent particulate material may be preferentially injected into the product gas at a location within the second zone where the gas temperature is in the range of optimum performance for the absorbent being utilized.

Further, the sulfur oxide absorbing particulate material is preferably entrained into a carrier gas prior to being dispersed into the second quantity of air introduced into the furnace. The second quantity of air is split into a plurality of air streams subdivided into at least a first and a second portion disposed about the periphery of the furnace at the first and second elevations respectively within the second zone. A portion of the carrier gas with the entrained sulfur oxide absorbent particulate material is then dispersed into each of the plurality of air streams before or as the air streams are introduced into the furnace chamber. The carrier gas may comprise preheated air, unpreheated air, recirculated product gases, or mixtures thereof.

BRIEF DESCRIPTION OF THE DRAWINGS

The method of the present invention will be described hereinafter with reference to the accompanying drawing wherein.

DESCRIPTION OF A PREFERRED EMBODIMENT

Figure 1:
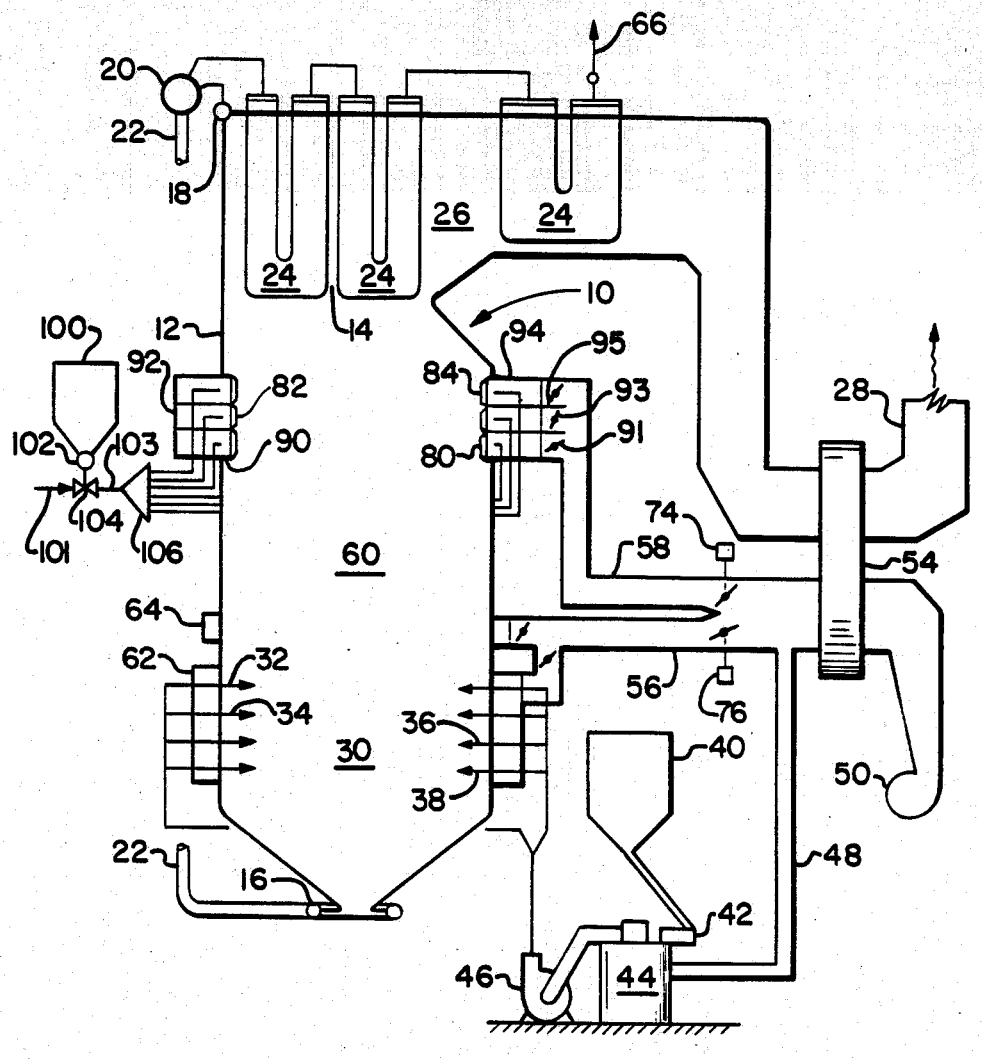
FIG. 1 is a sectional side elevational view, schematic in nature, showing a steam generator equiipped for operation in accordance with the present invention.
Figure 2:
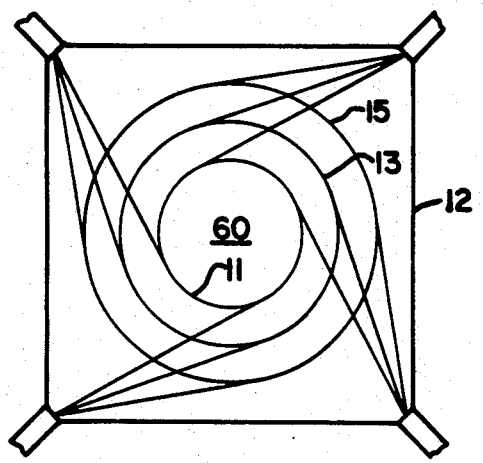
FIG. 2 is a cross-sectional plan view taken along line 2—2 of FIG. 1 looking down into the furnace chamber.

Referring now to FIG. 1, there is depicted therein a fossil fuel-fired steam generator having a vertically elongated furnace 10 formed of a plurality of upright waterwalls 12 enclosing a furnace chamber having a gas outlet 14 located at the upper end thereof. To generate steam, water is passed through the lower waterwall inlet header 16 upwardly through the waterwalls 12 forming the furnace 10. As the water passes upwardly through the waterwalls 12, it absorbs heat from the combustion of a fossil fuel within the furnace 10 and is first heated to saturation temperature and then partially evaporated to form a steam-water mixture. The steam-water mixture leaving the waterwalls 12 is collected in a waterwall outlet header 18 and then passed to drum 20 wherein the water and steam are separated.

The water separated from the steam-water mixture in the drum 20 is mixed with feedwater and passed through downcomer 22 back to the lower waterwall ring header 16 to be passed therefrom upwardly through the waterwalls 12 once again. The steam removed from the steam-water mixture in the drum 20 is passed through heat exchange surface 24, such as a superheater or a reheater, disposed in the exit gas duct 26 connected to the furnace outlet 14 for conveying the gases formed in the furnace to the steam generator stack. In passing through the heat exchanger surface 24, the steam is superheated as it is passed in heat exchange relationship with the hot gases leaving the gas outlet 14 of the furnace 10 through the gas exit duct 26.

The furnace 10 is fired by injecting fuel into the furnace in a first zone 30 through several fuel injection ports 32, 34, 36 and 38 located in the lower region of the furnace 10 remote from the gas outlet 14 thereof. The amount of fuel injected into the furnace is controlled to provide the total heat release needed to yield a desired total heat absorption for a given steam generator design. Although the furnace 10 is shown as a tangentially fired, pulverized coal furnace in the drawing, the present invention may be used with any type of furnace adapted to burn a sulfur bearing fossil fuel in suspension. In any event, the fuel is injected into the first zone 30 with a first quantity of air for burning in suspension in a lower region of the furnace 10 remote from the gas outlet 14 to generate hot product gases.

In pulverized coal firing, as shown in the drawing, raw coal is fed from a storage bin 40 at a controlled rate through feeder 42 to an air swept pulverizer 44 wherein the raw coal is comminuted to a fine powder-like particle size. Preheated air is drawn by an exhauster fan 46 from the air heater outlet through supply duct 48 and through the pulverizer 44 wherein the comminuted coal is entrained in and dried by the preheated air stream. The pulverized coal and air is then fed to the first zone 30 of the furnace 10 through fuel injection ports, i.e. burners, 32, 34, 36 and 38. The preheated air used in drying the pulverized coal and transporting the coal to the fuel injection ports is typically 10% to 20% of the total combustion air. Combustion air is supplied by forced draft fan 50 through air supply duct 52 to an air heater 54 wherein the combustion air is passed in heat exchange relationship with the gases passing from the furnace. A first quantity of the combustion air leaving the air preheater 54 is passed through duct 56 to the main windbox 62 disposed in the furnace walls 12 about the first zone 30 in the lower region of the furnace chamber and the overfire air windbox 64 disposed above the main windbox 62 in the upper region of the first zone 30. This first quantity of combustion air is distributed between the main windbox 62 and the overfire air windbox 64 in a conventional manner as is well known in the prior art to control the formation of nitrogen oxides within the combustion occurring within the first zone 30 of the furnace chamber.

To control the formation of nitrogen oxides in the combustion process, the portion of the first quantity of air supplied to the main windbox 62 typically constitutes about 100% or less of the combustion air required to completely combust the fuel. Thus, the combustion of the coal in zone 30 is carried out at or slightly under stoichiometric levels at a reduced temperature therefore resulting in lower nitrogen oxide formation. The remaining portion of the first quantity of combustion air is then introduced through the overfire air windboxes 64 disposed superadjacent or spaced above the main windbox 62 such that combustion is substantially completed within the first zone 30 of the furnace chamber. Some residual combustion may occur in the second zone 60 where unburned fuel and partially oxidized products of combustion, such as carbonmonoxide, are further oxidized so as to substantially complete combustion before the product gases leaving the furnace 10 through the furnace gas outlet 14 at the top thereof.

The absorption of sulfur oxides formed in the combustion process in the first zone 30 is effected in a second zone 60 in an upper region of the furnace 10 between the first zone 30 and the gas outlet 14 of the furnace 10. The sulfur oxide absorbing material, preferably an alkali material, for example powdered limestone or calcium hydroxide, is injected into the product gases passing through the second zone 60 at a location therein where the temperature of the product gases is greater than about 800 C. and less than of about 1200 C. if calcium hydroxide is the absorbent, to about 1400 C. if limestone is the absorbent. By injecting the sulfur oxide absorbing material into the product gases at a temperature less than about 1200 C. to about 1400 C., the phenomena of deadburning of the absorbing material is reduced. Therefore there is no loss in activity of the absorbent material. By injecting the absorbent material into the product gas at a temperature above about 800 C., it is ensured that the reaction rate for the absorption of sulfur oxides by the absorbent material is sufficiently high to provide acceptable absorption levels.

In accordance with the present invention the sulfur oxide absorbing particulate material is injected into the product gases at at least a first and a second elevation within the second zone 60. In the preferred embodiment for carrying out the present invention as illustrated in FIG. 1, the sulfur oxide absorbent is injected into the furnace through three elevations of injection nozzles 80, 82 and 84 arranged in a vertical array about the perimeter of the furnace 12, preferably with one vertically array of injection nozzles 80, 82, 84 at or near each of the four corners formed at the intersection of the furnace walls 12. Each of the elevations of injection nozzles 80, 82 and 84 is provided with its own individual windbox 90, 92 and 94 respectively, which distributes air to that elevation of injection nozzles only independently of the other elevations of injection nozzles. A second quantity of air is passed from the air heater 54 through duct 58 and distributed selectively amongst the windboxes 90, 92 and 94 as desired by the operator.

Sulfur oxide absorbing particulate material, for example pulverized limestone, is passed from a storage silo 100 through feeder 102 to entrainment means 104, such as a venturi feeder, wherein sulfur oxide absorbing particulate material is entrained in a carrier gas 101. The carrier gas may comprise preheated air, unpreheated air, or recirculated flue gas taken from the gas outlet duct 28 at a location downstream of the air heater 54, or mixtures thereof. The carrier gas 103 having the sulfur oxide absorbing particulate material entrained therein is conveyed to a splitting means 106 wherein the carrier gas 103 is subdivided into a plurality of substreams equal in number to the total number of injection ports 80, 82 and 84. The second quantity of air passed to the windboxes 90, 92 and 94 through supply duct 58 from the air preheater 54 is split into a plurality of air streams with one air stream supplied to each windbox 90, 92 and 94 independently of the other windboxes. A plurality of dampers 91, 93 and 95 are provided at the outlet of the gas duct 58 so that the second quantity of air may be distributed amongst the windboxes 90, 92 and 94. The gas flow dampers 91, 93 and 95 are independent of each other and may be selectively positioned so as to unequally distribute the quantity of air amongst the individual windboxes 90, 92 and 94. The portions of the second quantity of air supplied to each of the individual windboxes are each subdivided into a plurality of air streams which are admitted into the furnace 10 through the injection ports 80, 82 and 84 located at or near each of the corners of the furnace 10. A portion of the carrier gas with its entrained sulfur oxide absorbing particulate material is dispersed into each of the plurality of air streams by conveying the subdivided streams of carrier gas from the splitter 106 to a plurality of injection guns 98. One injection gun 98 is disposed within or upstream of each of the injection ports 80, 82 and 84 so as to inject the sulfur oxide absorbing particulate material entrained in the carrier gas into the individual air streams passing through the injection ports into the second zone 60 of the furnace 10.

The injection ports 80, 82 and 84 disposed at or near the four corners of the furnace at each elevation are directed tangentially to an imaginary circle within the second zone 60. That is, the injection nozzles 80 disposed at four corners of the lower elevation are directed to a first imaginary circle 11 within the second zone, the injection nozzles 82 disposed at the four corners of the intermediate elevations are directed to a second imaginary circle 13 within the second zone 60, and the injection nozzles 84 disposed at the corners of the furnace in the upper elevation are directed tangentially to a third imaginary circle 15. In order to ensure rapid and thorough mixing of the sulfur oxide absorbent across the plan area of the furnace, the imaginary circles within the second zone 60 to which the various elevations are directed have differing radii. Therefore, there is formed in the furnace a toroidal cloud at each elevation of sulfur oxide absorbing particulate material with the cloud at one elevation being of a different size than the cloud at the next elevation such that the sulfur oxide absorbing particulate material is dispersed over a wide furnace volume. Thus the product gases passing from the combustion zone 30 upwardly to the gas outlet 14 of the furnace through the second zone 60 will necessarily traverse these toroidal clouds of particulate material whereby the sulfur oxide gases in the product gases will be brought into intimate contact and absorbed by the sulfur oxide absorbing particulate material within the clouds.

The amount of air into which the absorbent material is dispersed is controlled at each of the elevation injection nozzles 80, 82 and 84 by controlling the dampers 91, 93 and 95 to the respective windboxes 90, 92 and 94. By controlling the amount of air supplied to each of the individual windboxes, the air velocity and momentum of the air streams introduced at each of the elevations may be independently and selectively controlled so as to provide any desired jet penetration and dispersion of the sulfur oxide absorbing particulate material into the furnace at each elevation of injection nozzles. Depending upon the temperature profile within the second zone 60, it may be desirable to provide a higher air velocity at one elevation than another to ensure greater penetration of the sulfur oxide absorbing particulate material into the gas stream at a particular location associated with one particular elevation of injection nozzles.

Additionally, the injection nozzles 80, 82 and 84 disposed at or near each corner at each of the three elevations of injection nozzles are capable of tilting upwardly or downwardly, typically through a range of +30 to −30 degrees, so that the sulfur oxide absorbing particulate material may be directed upwardly, horizontally or downwardly into the furnace so as to achieve injection of the particulate material into any desired temperature zone within the second zone 60 depending upon the gas temperature profile within the zone 60. Additionally, tilting of the nozzles upwardly or downwardly can also be used to control the residence time of the particulate material within the second zone 60. This tilting feature becomes particularly useful as the furnace is operated over a wide load range and the temperature profile of the gases traversing the second zone 60 will vary significantly with furnace load. For instance, it will generally be necessary to tilt the injection nozzles 80, 82 and 84 downwardly away from the furnace outlet towards the combustion zone 30 when the furnace is operated at low load in order to maintain contact between the sulfur oxide absorbing particulate material and the sulfur oxide gases at a temperature high enough to provide an adequate reaction rate thereby ensuring efficient sulfur oxide absorption. Conversely, at high furnace loads, it may be necessary to tilt the injection ports 80, 82 and 84 upwardly toward the furnace outlet 14 so as to inject the sulfur oxide absorbing particulate material into the second zone 60 in a region where the gas temperature is sufficiently low so as to preclude deadburning of the sulfur oxide absorbing particulate material.

Further, gas dampers 74 and 76 can be selectively positioned so as to control and distribute the flow of hot air from the air preheater 54 through duct 56 to the windboxes 62 and 64 serving the combustion zone 30 and the duct 58 supplying air to the windboxes 90, 92 and 94 serving the second zone 60. In this manner, the flow of air can be distributed between the first zone 30 and the second zone 60 so as to control the temperature profile within the furnace 10. Additionaly, the dampers 91, 93 and 95 can also be used to preferentially distribute the air flow between windboxes 90, 92 and 94 so as to fine-tune the temperature profile within the second zone 60 into which the sulfur oxide absorbing material in injected or even to alter the planar profile of temperature of the product gas at the furnace exit 14.

Accordingly, it will be appreciated that Applicant has provided an improved method of introducing a sulfur oxide absorbing particulate material into a fossil fuel-fired steam generating furnace wherein the sulfur oxide absorbing particulate material can be selectively and controllably distributed so as to obtain intimate and uniform mixing of the particulate material with the flue gas over a furnace volume within a gas temperature range at which the sulfur oxide absorbing particulate material will not deadburn but will be sufficiently reactive to provide efficient sulfur oxide absorption within the residence time of the particulate material within the furnace region.

While the Applicant has illustrated and described herein a preferred embodiment for carrying out his invention, it is to be understood that such is merely illustrative and not restrictive and that variations and modifications by those skilled in the art may be made to the embodiment shown without departing from the scope and spirit of the invention as recited in the claims appended hereto.

I claim:

1. In a fossil fuel-fired steam generator having a vertically elongated furnace with a gas outlet, steam generating tubes lining the walls of said furnace, fuel injection ports located in a lower region of the furnace remote from the gas outlet thereof, windbox means associated with the fuel injection ports for supplying combustion air to the furnace, and a gas exit duct opening to the gas outlet of said furnace for conveying gases therefrom, a method of firing said furnace comprising:

a. combusting a sulfur-bearing fuel in a first quantity of air in a first zone in the lower region of said furnace remote from the gas outlet thereof to generate hot product gases;

b. dispersing a sulfur oxide absorbing particulate material in a second quantity of air;

c. injecting the sulfur oxide absorbing particulate material dispersed in a second quantity of air into the product gases in a second zone in an upper region of said furnace between the first zone and the gas outlet of said furnace at at least a first and second elevation within the second zone through a plurality of air streams introduced at each elevation; and d. directing the sulfur oxide absorbing particulate material containing air streams introduced at the first elevation tangentially to a first imaginary circle within the second zone, and directing the sulfur oxide absorbing particulate material containing air streams introduced at the second elevation tangentially to a second imaginary circle within the second zone, the first and second imaginary circles having differing radii, the step of dispersing a sulfur oxide absorbing particulate material in a second quantity of air into the product gases in a second zone comprising splitting the second quantity of air into a plurality of air streams, the pluality of air streams subdivided into at least a first and a second portion disposed about the periphery of said furnace at the first and the second elevations respectively; entraining the sulfur oxide absorbing particulate material into a carrier gas; and dispersing a portion of the carrier gas with the entrained sulfur oxide absorbing particulate material into each of the plurality of air streams.

2. A method of firing a furnace as recited in claim 1 further comprising selectively directing the plurality of air streams with sulfur oxide absorbing particulate material dispersed therein into said furnace upwardly towards the gas outlet of said furnace, horizontally, or downwardly away from the gas outlet of said furnace so as to inject the sulfur oxide absorbing particulate material into the product gas at a location within the second zone wherein the gas temperature is in the range of optimum performance for the sulfur oxide absorbing particulate material.

3. A method of firing a furnace as recited in claim 2 wherein the sulfur oxide absorbing particulate material is selected from the group comprising pulverized limestone, calcium hydroxide powder, and mixtures thereof, and the gas temperature at the location within the second zone wherein the sulfur oxide absorbing particulate material is injected into said furnace is in the range from about 800 C. up to about 1400 C.

4. A method of firing a furnace as recited in claim 1 further comprising controlling the quantity of air in the air streams into which the sulfur oxide absorbing particulate material is dispersed for introduction at the first elevation and independently therefrom controlling the quantity of air in the air streams into which the sulfur oxide absorbing particulate material is dispersed for introduction at the second elevation.

5. A method of firing a furnace as recited in claim 1 wherein the carrier gas is selected from the group comprising preheated air, unpreheated air, recirculated product gases, and mixtures thereof.

* * * * *